United States Patent [19]

Stadler et al.

[11] Patent Number: 4,875,414

[45] Date of Patent: Oct. 24, 1989

[54] EXPLOSIVE CHARGE WITH A PROJECTILE-FORMING METALLIC INSERT

[75] Inventors: Hansjörg Stadler, Rückersdorf; Klaus von Laar, Lauf, both of Fed. Rep. of Germany

[73] Assignee: Diehl GmbH & Co., Nuremberg, Fed. Rep. of Germany

[21] Appl. No.: 151,713

[22] Filed: Feb. 3, 1988

[30] Foreign Application Priority Data

Feb. 20, 1987 [DE] Fed. Rep. of Germany ..... 3705381

[51] Int. Cl.[4] ..... F42B 1/00

[52] U.S. Cl. ..... 102/307; 102/309; 102/476

[58] Field of Search ..... 102/307, 309, 476

[56] References Cited

U.S. PATENT DOCUMENTS 4,551,287 11/1985 Bethmann ..... 264/3 R
4,598,643 7/1986 Skrocki ..... 102/307
4,711,181 12/1987 Ringel et al. ..... 102/476

*Primary Examiner*—Peter A. Nelson
*Attorney, Agent, or Firm*—Scully, Scott, Murphy & Presser

[57] ABSTRACT

An explosive charge with a projectile-forming metallic insert which, essentially, possesses the configuration of a spherically-curved dish. The insert should be constituted of a body from a single-crystal. Pursuant to a modification, in an explosive charge of the above-mentioned type which additionally possesses a member for the guidance or deflection of the detonation waves, it is contemplated that this member be also constituted from a single-crystal.

7 Claims, 1 Drawing Sheet

[100]

[111]

EXPLOSIVE CHARGE WITH A PROJECTILE-FORMING METALLIC INSERT

BACKGROUND OF THE INVENTION

1. Field of the Invention

The present invention relates to an explosive charge with a projectile-forming metallic insert which, essentially, possesses the configuration of a spherically-curved dish.

2. Discussion of the Prior Art

Explosive charges of the type under consideration are already known from the disclosure of German Pat. 33 17 352. The explosive charges are constituted of a cylindrical container which is filled with an explosive. A metallic insert is positioned on the front side of the container and essentially possesses the shape of a spherically-curved dish or saucer. Located on the opposite side of the container is a fuze device or detonator for the triggering of the explosive. The mechanism of the action of such a type of explosive charge, which in distinction to a cutting charge, is designated as a so-called P-charge (projectile-forming charge), consists of in that, upon the detonation of the explosive, the insert is folded into a projectile having a length of a few centimeters, which because of its high speed of flight and its mass is imbued with an armor-rupturing effect. The distinction with regard to a cutting charge consists of in that in the last-mentioned there is produced a slender, drawn-out metallic jet which, as a rule, cuts open a target located within a short distance through the effects of heat. In contrast therewith, the P-charge projectile is adapted to fly over a greater distance, such as normal projectile, and penetrates the target in response to its inertial force. The temperature of the airborne body plays no role in this instance.

In the folding of the insert for the formation of a projectile, there is encountered the problem that the projectile may not be rotationally-symmetrical, but for the purpose of good flight characteristics should, if possible, be imparted small stabilizing fins. This is effectuated pursuant to the above-cited state-of-the-art in that the insert possesses regions of different thicknesses about its peripheral or annular surface such that, upon the folding of the insert, there can be produced a body which is not rotationally-symmetrical. The production of such inserts is quite expensive due to its complicated surface configuration.

SUMMARY OF THE INVENTION

Accordingly, it is an object of the present invention to provide an explosive charge with a projectile-forming insert, which possesses the same effect in a target, but the manufacture of which is less expensive then is the case for an explosive charge produced pursuant to the current state-of-the-technology. In this connection, there should also be afforded the capability for a good forming of the stabilizing fins.

In order to achieve the objects set forth by the present invention, pursuant to a first alternative it is proposed that the insert be constituted of a body from a single-crystal. Pursuant to a second alternative for attaining the foregoing objects, in an explosive charge of the above-mentioned type which additionally possesses a member for the guidance or deflection of the detonation waves, it is contemplated that this member be also constituted from a single-crystal.

Pursuant to a preferred modification of the invention, it is proposed that the projectile-forming insert, as well as the member for the deflection of the detonation waves, each be respectively constituted from a single-crystal.

Evidenced as particularly adapted as the preferred material for the metallic insert has been pure copper; however, it is also possible to contemplate the utilization of copper alloys, to the extent that they are capable of being single-crystalline. Furthermore, for this purpose, it is also possible to consider the utilization of tantalum and iron.

In order to produce the projectile body in a configuration which is not rotationally-symmetrical, in accordance with a further modification of the invention it is proposed that the orientation of the crystal axis of the single-crystal be [100]. In this instance, there is obtained a 4-numbered projectile body; meaning, with four stabilizing fins.

If in contrast therewith there is to be produced a projectile body with a 3-numbered configuration, then pursuant to a further proposal of the invention there must be selected an orientation [111] for the crystal axis of the single-crystal.

Single-crystals are bodies, preferably constituted of metal, which are propagated in accordance with special methods, and in contrast with the polycrystalline bodies which are encountered in the technology and during daily life, are constituted of only a single, although, occasionally, large crystal. Thereby, this relates to chemically highly-pure bodies, which in their behavior extensively conform to the theoretical behavior of the pure crystal of the applicable element. These single-crystalline bodies are anisotropic, have no grain boundaries, such as would be the case for polycrystalline bodies, and their strength along certain crystal axes is significantly higher than in the instance of polycrystalline material.

Single-cystals can be produced not only from pure elements, but they can also be produced from alloyed metals. Thus, in accordance with the type of element or alloy, they evidence a more or less intense or distinct anisotropy, meaning, that their properties are different along the crystal axes [100], [110], and [111]. For example, these properties are the modulus of elasticity, the strength or the limiting deformation stress. As an example, for copper, which possesses an extremely distinct anisotropy, the moduli of elasticity upon loading or stressing in the direction of the above-mentioned crystal axes are, respectively, about 6800, 12,000 and 18,000 $kp/mm^2$.

The distinct anisotropy of single-crystals, especially single-crystals of copper, may be employed by the present invention in that at a loading or stressing of the single-crystal by means of the explosive, this single-crystal upon a pregiven orientation of its crystal axes, for example [100], will, in accordance with the structure of its matrix, possesses a different speed and intensity of disintegration, such that a cylindrical single-crystalline body will under a suitably intense deformation caused by pressure or tension, subsequently possess a distinct asymmetry with respect to its axis of rotation; however, whereby this asymmetry is reproducibly dependent upon the structure of the matrix. It has been determined in the testing technology that in the tensile testing of single-crystals having the orientation [100] for the crystal axis, a round single-crystal rod has at its location of constriction (necking down), a shape which is similar to a four-leaf clover leaf. For single-crystal rods having the orientation [111] for the crystal axis, during the deformation of a body, there is accordingly obtained a three-leaf clover leaf. Also this deformation is readily reproducible, and is only obtained for single-crystals having the orientation [111].

Through the utilization of this knowledge, pursuant to the invention, there can be employed a single-crystalline insert in the shape of a spherically-curved dish or saucer, in which the single crystal possesses an orientation [100] or [111] of the crystal axes. Obtained thereby during the folding of the insert, are projectile bodies with four or three stabilizing fins, whereby through the formulation of the insert; for example; with regard to its thickness, it must be ensured that the stabilizing fins do not begin already at the head end of the projectile, but first only in the rearward section thereof.

Through the utilization of a member for the deflection of the detonation waves, the above-mentioned purpose can be similarly achieved or even further enhanced. When a single-crystal is employed for a member of that type, but in contrast therewith a conventional material for the insert, then the insert must be configured somewhat as indicated in the above-mentioned state-of-the-technology. By means of the member for the deflection of the detonation waves, because of the disintegration thereof it is possible to exert an influence over the subsequent folding of the insert. Hereby, the above-mentioned member must be spatially so associated with regard to the insert, that the lines of its weak crystal structure cooperate with the regions of the insert which also possess a weak structure, for example, a low material thickness.

Within the context of the invention, the utilization of a single-crystalline body or member for the deflection of the detonation waves is, however, especially advantageous when the insert is also constructed single-crystalline and from the same material. In this instance, the orientations of the crystal axes of the insert and that of the member should be the same, and there should be effected a spatial association of both components in the previously described manner.

BRIEF DESCRIPTION OF THE DRAWINGS

Reference may now be had to the following detailed description of exemplary embodiments of the invention, taken in conjunction with the accompanying drawings; in which.

DETAILED DESCRIPTION

Figure 1:
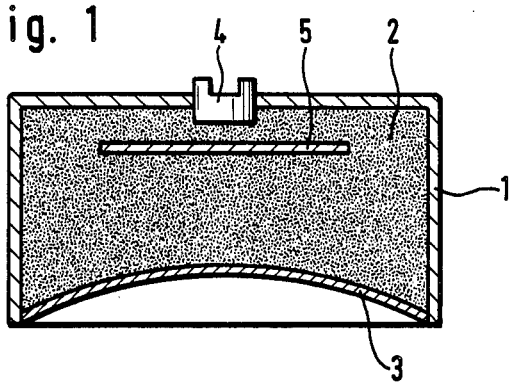
FIG. 1 illustrates a generally schematic longitudinal cross-sectional view through an explosive charge in conformance with the invention.

In FIG. 1 there is illustrated, in a longitudinal sectional view, an explosive charge, disclosed in a generally schematic representation. Ascertainable in the drawing is a container 1 which is filled with an explosive 2. Located on one side of the container is an insert which is constituted from a single-crystal 3 of copper. On the other side of the container there is located a fuze or detonating device 4. Finally, there is also provided a member 5 for the deflection of the detonation waves; which is advantageous within the context of the invention, but which need not be necessarily employed herein. For example, the insert 3 possesses a diameter of 5 cm, and can be of a constant material thickness over its entire surface; however, within the scope of the invention there can also be contemplated a thickening of the insert inwardly or outwardly thereof.

Figure 2:
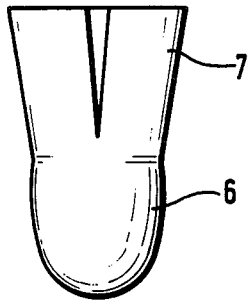
FIG. 2 illustrates a folded insert subsequent to the detonation.

A projectile body, as it is airborne after detonation in a direction towards a target, is illustrated in FIG. 2 in an idealized configuration. In accordance with the diameter and thickness of the insert 3, this projectile body can vary in its ratio of length to thickness.

Figure 3:
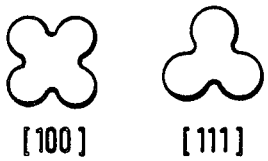
FIG. 3 illustrates a typical folding at the different orientations of the crystal axes.

In FIG. 3 there is shown the manner in which a round single-crystal rod will behave during deformation in dependence upon its crystal axes orientation. In the case of the orientation [100] of the axis, there is obtained a 4-numbered configured body similar to a 4-leaf clover leaf. When in contrast therewith, the single-crystal has an orientation corresponding to [111], then after deformation there is obtained a 3-numbered body, similar to a 3-leaf clover leaf. Inasmuch as the deformation of the insert 3 upon detonation does not represent an ideal deformation, the formation of the stabilizing fins 7, as shown in FIG. 2, will also deviate to a greater or lesser extent from the shapes shown in FIG. 3; however, in principle, will maintain its 4-numbered or 3-numbered configuration.

Figure 4:
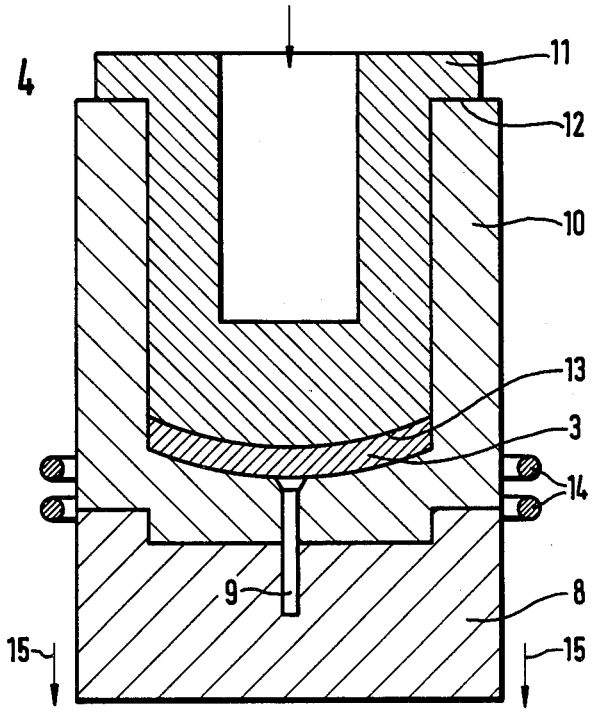
FIG. 4 illustrates in a schematic representation, a transverse cross-sectional view through a worktool utilized for the production of a single-crystal insert.

On the basis of the representation in FIG. 4, there is elucidated a possible manufacturing process for an insert 3. A member 5 for a deflection of detonation waves which essentially represents a planar circular surface or disk, can be propagated in basically the same manner as the insert 3. Inserted into a base member 8 of a worktool is a single-crystal seedling 9 with an orientation of the crystal axes which is to be imparted to the subsequent single-crystal.

On the base member 8 there is seated a crucible-like receptacle 10, into which there projects the seedling 9. This receptacle 10 has a recess in its bottom surface in which it is adapted to receive the single-crystalline insert. Serving for the covering of the receptacle 10 is a spring-loaded ram 11 which is configured such that upon the seating of its outer annular surface 12 on the receptacle 12, the end surface 13 thereof is at such a spacing relative to the bottom surface of the receptacle 10, that the single-crystalline insert will, in its final condition, completely fill out the interspace which is present. A high-frequency coil 14 has its windings arranged so as to extend about the receptacle 10, so that in the bottom position thereof, as illustrated, it can heat and melt the insert. Employed as the material which is to be melted is a pure copper body constituted of polycrystalline material, which, to some extent, already evidences the shape of the subsequent insert. This body is now heated by a high-frequency field of the coil 14 and melts. Concurrently, the upper portion of the seedling 9 also begins to melt and imparts its crystal orientation to the lowermost portion of the molten insert. The base member 8 and the receptacle 10 are now slowly lowered in the direction of arrows 15, and now also the upper portion of the insert 13 is melted down. As a result, a crystal growth front extends within the insert upwardly from below, with the orientation of the crystal axes being that of the seedling. The base member 8 and the receptacle 10 are then slowly lowered further and withdrawn from the high-frequency coil. The melt material of the insert 3 solidifies now slowly into a single-crystal. As soon as the single-crystal has sufficiently cooled down, the ram 11 is withdrawn from the receptacle 10, and the finished single-crystal 3 can be removed from the receptacle 10 after separation from the seedling 9. Any further processing or treatment of the single-crystal is no longer required.

What is claimed is:

1. Explosive charge with a projectile-forming metallic insert, said insert essentially having the shape of a spherically-curved dish, said insert being a body constituted from a single-crystal possessing an orientation of the crystal axes in a prescribed direction, said orientation being selected from the group consisting of [100] and [111] as shown in FIG. 3.

2. Explosive charge with a projectile-forming single-crystalline metallic insert, said insert essential having the shape of a spherically-curved dish having an orientation of the crystal axes selected from the group consisting of [100] and [111] as shown in FIG. 3, and a member for the deflection of detonation waves, said member for the deflection of the detonation waves being constituted from a single-crystal possessing an orientation of the crystal axes in a prescribed direction.

3. Explosive charge as claimed in claim 2, wherein the projectile-forming insert and the member for the deflection of the detonation wave are each constituted from a single-crystal.

4. Explosive charge as claimed in claim 2, wherein the single-crystalline insert and the member for deflecting the detonation waves are each constituted of pure copper or from a copper alloy.

5. Explosive charge as claimed in claim 2, wherein the single-crystalline insert and the member for deflecting the detonation waves each have an orientation [100] of the crystal axes.

6. Explosive charge as claimed in claim 2, herein the single-crystalline insert and the member for deflecting the detonation waves each have an orientation [111] of the crystal axes.

7. Explosive charge as claimed in claim 2, wherein the insert and the body for deflecting the detonation wave have the same orientations of the crystal axes, and are orientated relative to each other in the same directions of effect with regard to their matrix structures.

* * * * *